US005752896A

United States Patent [19]

White

[11] Patent Number: 5,752,896

[45] Date of Patent: May 19, 1998

[54] HAND AND FINGER EXERCISE AND STRENGTHENING DEVICE AND METHOD OF EXERCISING AND STRENGTHENING SAME

[76] Inventor: Steven Aaron White, 430 Beechmont Dr., New Rochelle, N.Y. 10804

[21] Appl. No.: 780,342

[22] Filed: Jan. 8, 1997

[51] Int. Cl.[6] ..... A63B 23/16

[52] U.S. Cl. ..... 482/47; 482/44

[58] Field of Search ..... 482/44, 47, 49

[56] References Cited

U.S. PATENT DOCUMENTS

| | | | |
|---|---|---|---|
| 3,111,322 | 11/1963 | English | 482/47 |
| 3,447,415 | 6/1969 | Kime | 482/47 |
| 3,738,651 | 6/1973 | Norman et al. | 482/47 |
| 4,350,335 | 9/1982 | Pasbrig | 482/47 |
| 4,678,181 | 7/1987 | Ditsch et al. | 482/47 |
| 5,147,256 | 9/1992 | Silagy | 482/47 |
| 5,431,611 | 7/1995 | Silagy | 482/47 |
| 5,533,949 | 7/1996 | Hwang | 482/47 |

*Primary Examiner*—Lynne A. Reichard

*Attorney, Agent, or Firm*—Willard Alonzo Stanback, P.C.

[57] ABSTRACT

This invention relates generally to an exercise and strengthening device for fingers and hands and a method of exercising and strengthening same, along with certain muscles of the arm(s). More particularly, it relates to a device which applies a reactive force against the hand(s) and one or more of the fingers of a user when the device is held firmly in one or both of a user's hands. The user specifies the hand(s) and finger(s) upon which the device applies such force by either selecting an appropriately configured device or fixing a changeable device in a desired configuration. The device is preferably configured to resemble the grips of an instrumentality the user would hold while working (e.g., the grip of a hand tool) or while playing a sport (e.g., the grip of a golf club or baseball bat). The invention also relates to a method of exercising or rehabilitating fingers, individually or as a group, to strengthen the hand(s) and desired finger(s) thereof.

7 Claims, 6 Drawing Sheets

HAND AND FINGER EXERCISE AND STRENGTHENING DEVICE AND METHOD OF EXERCISING AND STRENGTHENING SAME

FIELD OF THE INVENTION

In general, this invention relates to a hand-held device used to exercise and strengthen the muscles of a user's hand(s) and finger(s), along with, to a lesser degree, certain muscles of his or her arm(s), and, more specifically, to a hand-held device which may be configured in the shape and style of a grip for a hand tool or sports apparatus and may be used, depending upon the specific embodiment, to exercise individual finger(s) of one or both hands and/or group(s) of fingers of one hand or both hands, either alternatively or simultaneously.

BACKGROUND OF THE INVENTION

The desired levels of strength in a person's fingers is dependent upon, among other things, what that person does with his or her hands. (The terms "finger" or "fingers" as referred to herein are meant to include the thumb where appropriate unless indicated otherwise.) The use of the hand and fingers during basic daily activities, such as writing, opening the mail and turning doorknobs, typically exercise and strengthen a person's fingers for continued daily use. At times, however, it is desirable for a person to increase the strength in one or more fingers of a hand while the strength of the other fingers remains relatively constant (or increases to a lesser degree). For instance, a person recovering from an injury to a finger may discover that the injured finger does not have the strength it once possessed. The differentiation between the strength of the recovering finger and the healthy fingers may cause the person's overall grip to weaken and his or her coordination to be unbalanced. For instance, it could adversely affect daily activities that warrant a strong grip, such as, for instance, during the operation of hand tools like hammers, screw drivers, axes, and saws.

Although an imbalance in strength levels, such as the natural imbalance caused by daily use of fingers in differing ways, may not have a significant impact upon the performance of a person's basic daily activities, in special situations it may be essential that the strength in one or more fingers be increased to exert more than the forces required for everyday activities. For example, it has been documented that although a proper grip for a golf club utilizes all ten fingers, varying degrees of force should be exerted by each finger to affect a desirable motion during the swing of the club. This variance is facilitated by the strengthening of certain fingers in relation to others. For the right-handed golfer, it has been documented that superior strength in the last three fingers of the left hand and in the middle and fourth fingers of the right hand, relative to the remaining fingers, fosters a more apt swing. For lefthanders, the stronger fingers are preferably the last three fingers of the right hand and the middle and fourth fingers of the left hand. (In either case, the pincers (i.e., the thumb and the first finger) of both hands are preferably relatively weaker.) In other sports, such as, for instance, baseball, tennis, cricket, racquetball, squash, and other sports where the player must grip an instrumentality in one or both hands, the desired relative strengths of the fingers of each hand may also differ.

Also, when strengthening is for the benefit of a particular activity (e.g., a sport or task for work), it is preferable for a person to exercise and strengthen certain fingers and to practice his or her grip in the manner that mimics the intended use. In cases where, for example, a carpenter is recovering from an injury, it would be desirable for the exercise to mimic the act of a carpenter firmly holding a device that resembles a hammer's grip. Where, for example, a golfer is working to improve his or her golf swing, it is preferable that the method of exercising the designated fingers simulates the act and feel of gripping a golf club in a traditional manner.

Hand and finger excising devices are documented in, for example U.S. Pat. Nos. 689,952; 756,480; 3,216,259; 3,357,702; 4,105,200; 4,240,624; 4,323,232; 4,433,364; 4,513,962; 4,553,746; 4,629,186; 4,634,114; 4,730,827; 4,753,434; 4,754,963; and 4,763,896. These prior devices, however, do not allow the user to easily focus his or her strengthening efforts on individual fingers, or selected groups thereof. The prior art includes devices which are relatively cumbersome; they have wide openings which, at times, can be awkward to use. These devices also typically have elements that do not effectively exercise an injured finger, apart from other fingers, and they typically strengthen fingers that the person may not want to be stronger (for a certain type of grip). Moreover, many are not configured to exercise and train the fingers in a manner that is readily transferable to application of the strengthened grip on actual hand tools or sports apparatus.

Objects

It is thus an object of the present invention to provide a hand and finger exercising device that is capable of strengthening a person's hand(s) and selected fingers of such hand (s).

A further object of the present invention is to provide a device that is configured to resemble the grip of an instrumentality for which the user is training to operate.

Another object of the present invention is to provide a method of exercising and strengthening an injured finger of a hand while not exercising or strengthening other fingers of the same hand.

Yet another object of the present invention is to provide a method of exercising and strengthening a person's grip through an act that is readily transferable to the actual act of holding a desirable instrumentality.

Still another aspect of the present invention is to provide a device for and a method of strengthening fingers by exerting forces of differing magnitude on such fingers.

The foregoing objects and advantages of the invention are illustrative of those which can be achieved by the present invention and are not intended to be exhaustive or limiting of the possible advantages which can be realized. Thus, these and other objects and advantages of the invention will be apparent from the description herein or can be learned from practicing the invention, both as embodied herein or as modified in view of any variations which may be apparent to those in the art. Accordingly, the present invention resides in the novel parts, constructions, arrangements, combinations and improvements herein shown as described.

SUMMARY OF THE INVENTION

The present invention is directed to a hand-held device for exercising hand(s) and a finger or group of fingers of such hand(s), along with, to a lesser degree, certain muscles of the user's arm(s). The main member, the primary structure of such device, is configured and sized to be held in the user's hand or hands in a fashion similar to the grips of, for example, golf clubs, baseball bats, tennis rackets, hand tools and other hand-held instrumentalities. In the preferred embodiment, the user is able to engulf the device when it is held firmly in one or both hands, depending upon the desired configuration, in a similar fashion as the user would hold other hand-held instrumentalities. Extending from the outer surface of the main member is a compressible element or a number of compressible elements. The compressible element(s) have an outer surface that exerts a force on one or more of the user's finger when the user holds the device firmly. In some preferred embodiments of the device, the main member is cylindrical in shape and completely engulfable. Further, it is preferably sized and cylindrically configured to resemble the grip of, for example, a golf club or a baseball bat. It may be also sized and configured in a shape to resemble the grip of, for example, a tennis or other racket, or a hand tool. The main member preferably has a texture similar to the grip it resembles, if any.

In accordance with a further aspect, the present invention is directed to a device where the compressible element(s) may be positioned to exert a force upon a selected finger or group of fingers. It may also, in other embodiments, exert specific and differing forces, as selected by the user, upon each finger to be exercised and strengthened. Preferably, the movement of the surface(s) of the compressible element(s) in contact with the finger(s) being exercised and strengthen is terminated when the device is held firmly and the outer surface(s) of the compressible element(s), which are in contact with such finger(s), are in alignment with the outer surface of the main member. More preferably, the compressible element(s) recess into the main member when the device is held firmly. The outer surface(s) of the compressible element(s), or layer(s) thereon, preferably has a texture similar to the surface of the main member.

In accordance with a still further aspect, the present invention is directed to a device where the compressible element(s) include one or more springs. Preferably, such spring(s) have a layer or object (e.g., a peg) connected thereto and protruding outward through holes in the main member and away from the outer surface of the main member. In other embodiments, the compressible element(s) are lockable in the compressed position. In still other embodiments, the main member is a length sufficient for the device to be held firmly by both of the user's hands without overlap.

BRIEF DESCRIPTION OF THE DRAWINGS

There are seen in the drawings forms of the present invention which are preferred and which represent the best mode presently contemplated for carrying out the invention. It is understood, however, that the invention is not limited to the precise arrangements and instrumentalities shown.

DETAILED DESCRIPTION OF THE PREFERRED EMBODIMENTS

Figure 1:
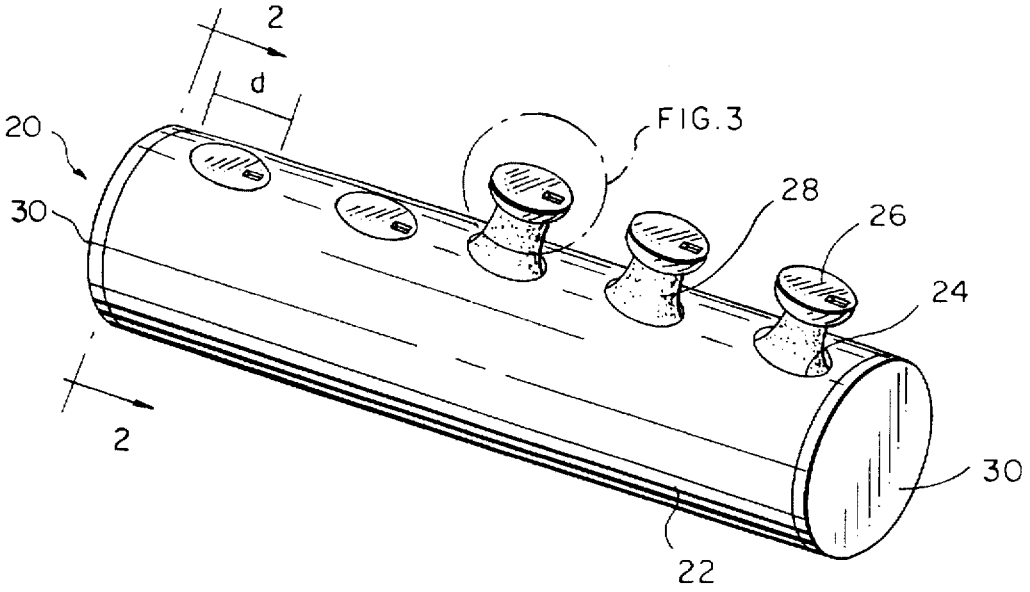
FIG. 1 is an isometric view of one embodiment of the present invention.
Figure 2:
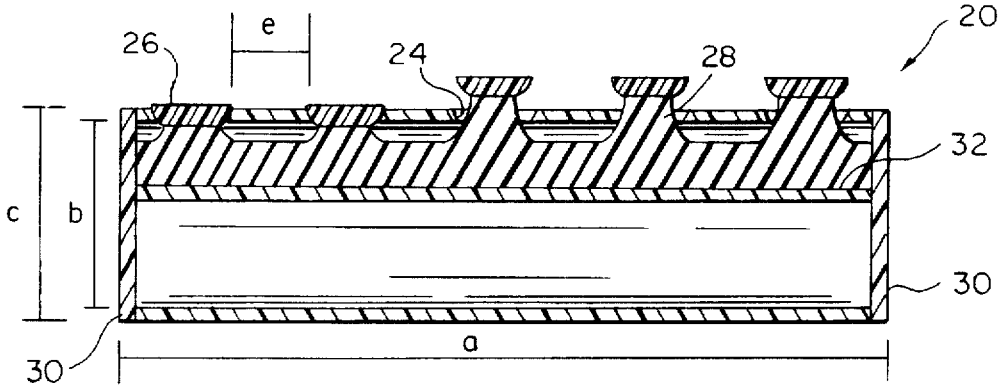
FIG. 2 is a side view in cross section of the main member of device shown in FIG. 1.

FIGS. 1 and 2 show device 20, an embodiment in accordance with the present invention. Main member 22, the primary structure of device 20, has holes 24 therein. Holes 24 may either be covered by caps 26, whose outer surface is aligned with the outer surface of main member 22, or be filled with a portion of compressible element 28, which extends outward beyond the outer surface of main member 22. In this embodiment, compressible element 28 is made of an elastic material, such as rubber or an equivalent. Ends 30 close the distal openings of main member 22. Support 32, which holds compressible element 28 in fixed relation to the inner surface of main member 22, is positioned inside of main member 22 and held in place by ends 30.

Main member 22, in this embodiment, is in the shape of a cylindrical tube, is sized to be engulfed by a single hand, and has a length measuring "a" with an inner diameter measuring "b" and an outer diameter measuring "c". In this embodiment, "a", "b" and "c" are approximately 100 mm, 30 mm and 25 mm, respectively. One of ordinary skill in the art would know that main member could vary in shape (e.g., a square, rectangular or tapered tube) and may be lengthened to be held by two hands without overlap. Main member 22 could be made of any number of materials or combinations of materials, but, for this embodiment, it is preferably made of a strong, light weight plastic.

Holes 24 in main member 22 are situated in proximity to the locations where the fingers of a user's hand rest when main member 22 is held firmly in that hand. In this embodiment of the present invention, holes 24 have beveled sides and are round with diameters measuring "d" at the surface of main member 22. In this embodiment, "d" is approximately 10 mm. One of ordinary skill in the art would envision that additional holes 24 could be made in a longer main member 22 to make device 20 usable with both of a user's hands without overlap. Other embodiments of device 20 could include fewer holes 24 (for example, there may be no hole 24 corresponding to the user's thumb if the configuration of the applicable grip resulting in the thumb being positioned over the fingers). The distance between holes 24 is in this embodiment is "e" - approximately 10 mm.

Figure 3:
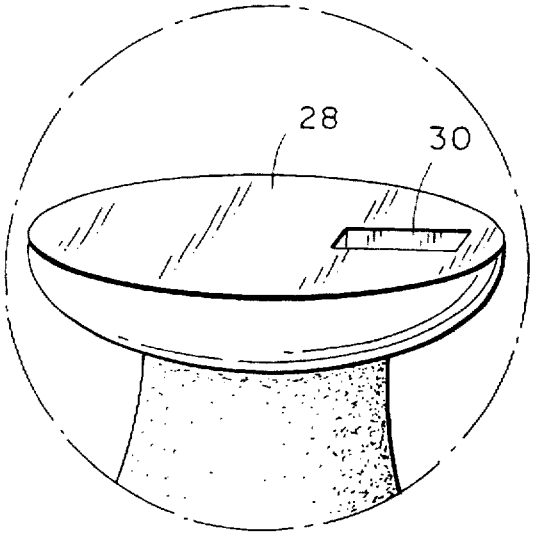
FIG. 3 is an isometric view of a cap usable with the device shown in FIG. 1.

FIG. 3 shows cap 26, which is fashioned to fit in beveled holes 24, and could be made of a number of materials or combinations of materials. In the embodiment of the present invention shown in FIGS. 1 and 2, caps 26 are held in place in holes 24 by frictional fits between them that are stronger than the outwardly exerted force of compressible element 28 on the surface of caps 26 inside of main member 22. Preferably, the outer surface of caps 26 would be made of a material close in texture to the outer surface of main member 22. Notch 30 of cap 26 is sized and located on cap 26 such that the user of the device may position the point of an instrumentality (e.g., the pointed end of a small screwdriver) in notch 30. By exerting an angled force on cap 26 at notch 30, cap 26 may be extracted from holes 24.

Figure 4:
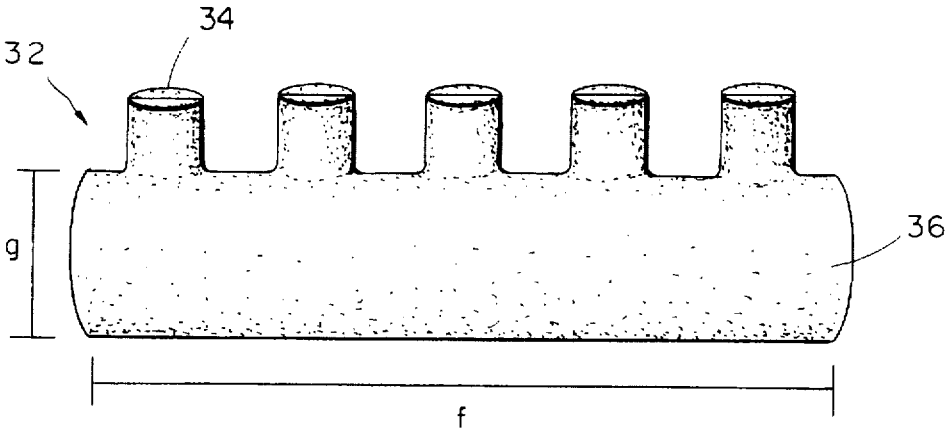
FIG. 4 is an isometric view of an example of a compressible element usable in certain embodiments of the present invention.

FIG. 4 shows another embodiment of the compressible element in accordance with the present invention. Compressible element 32 preferably includes five stems, each with outer surface 34, a layer having a texture similar to the texture of the outer surface of the device in which compressible element 32 is housed. Body 36 of compressible element 32, in this embodiment, is a rubber or other material that can exert a force against the fingers of a user when the device in which the compressible element 32 is housed is held firmly in the user's hand(s) and is primarily cylindrical in shape with the five cylindrical stems extending therefrom. Its base measures "f" and "g" in length and height, respectively. In this embodiment, "f" and "g" are approximately 90 mm and 20 mm, respectively. The outward force exerted by body 36 through outer surface 34 on the user's fingers may be varied by, for example, the use of materials with differing compositions. One skilled in the art would realize that outer surface 34 of compressible element 32 could be made of any number of materials.

Figure 5:
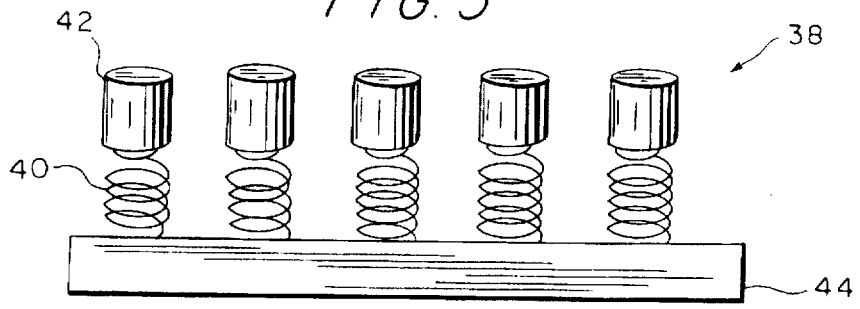
FIG. 5 is a side view of an example of another compressible element usable in certain embodiments of the present invention.

FIG. 5 shows another embodiment of a compressible element. Compressible element 38 includes springs 40 and pegs 42. In this embodiment, springs 40 are attached to support 44, l l which may be affixed to the inner surface of the device in which compressible element 38 is housed. One of ordinary skill in the art would realize that the attachment of support 44 to the device may be accomplished by a variety of means. Springs 40 may be of the type commonly available or specially made for use with compressible element 38 and may be of any size to fit the device in which compressible element 38 is housed (or any other applicable embodiment of the present invention). Like body 36 of compressible element 32 shown in FIG. 4, one of ordinary skill could envision that the force exerted by springs 40 against the finger(s) of the user when the combination of pegs 42 and springs 40 is compressed (i.e., when the device in which compressible element 38 is housed is held firmly in the user's hand(s)) is dependent upon the configuration and stiffness of springs 40.

One of ordinary skill in the art would realize that compressible elements 32 and 38, as well as other materials and apparatus which function in a similar manner, may be used with various embodiments of the present invention. One of ordinary skill in the art would also realize that the forces exerted upon the finger(s) of the user of such devices may be varied by the use of compressible elements with differing properties. Alternatively, the same compressible element with differing properties may be used. For example, the portion of a rubber or other elastic material extending through the holes corresponding to the fingers to be exercised may have different elasticities at each hole. In such case, the forces exerted on each finger by the device in which such compressible element is housed may be different.

Figure 6:
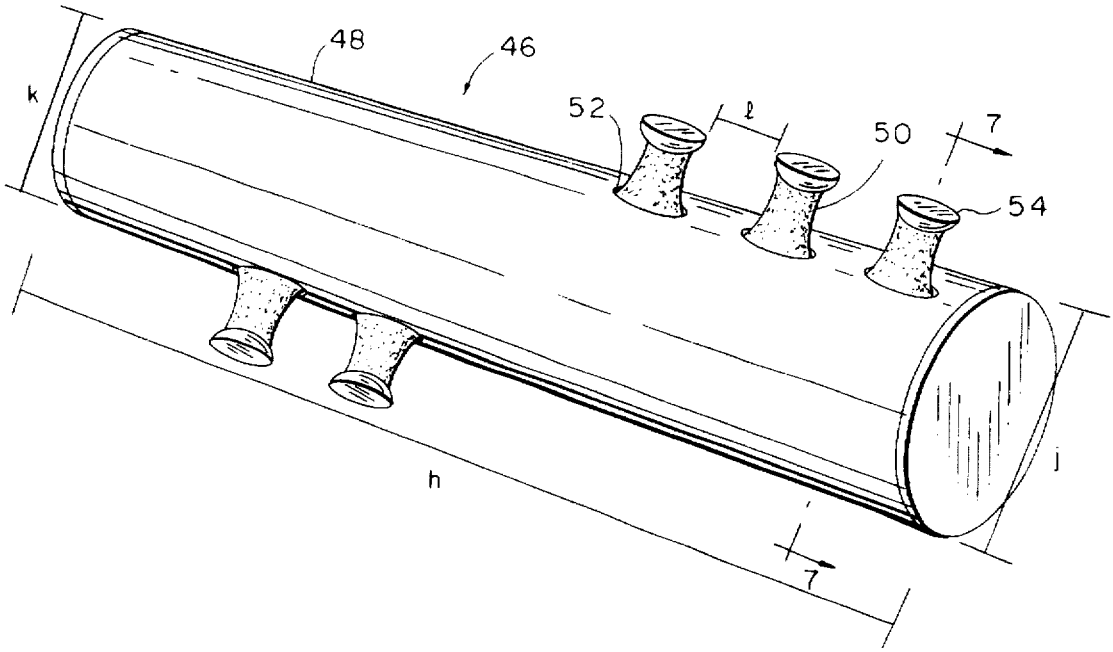
FIG. 6 is an isometric view of an embodiment of the invention that resembles a golf club grip.
Figure 7:
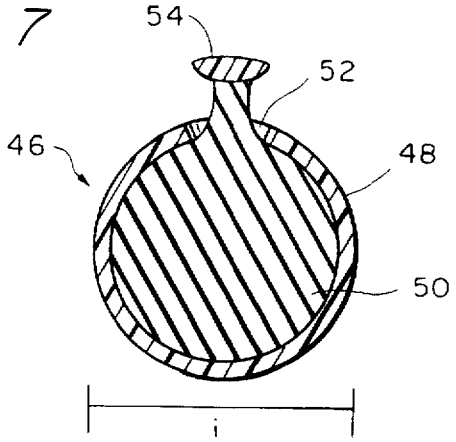
FIG. 7 is a view, in cross section, of the device shown in FIG. 6.

FIGS. 6 and 7 show an embodiment of the present invention that would be useful, in particular, to golfers. Main member 48 of device 46 is configured similarly to the grip of a golf club. As such, main member 48 measures "h" long and has an inner diameter measuring "i". The outer surface is tapered and measures from a diameter of "j" at one end to a diameter of "k" at the other end. In this embodiment, "h", "i", "j" and "k" are 275 mm, 13 mm, 27 mm and 20 mm, respectively. Compressible element 50, made of rubber in this embodiment, fills main member 48 while portions of it extend through holes 52. Configured for a right-handed golfer, device 46, by the force of the portion of compressible element 50 extending through the three holes 52 on the one side of main member 48, exerts forces on the last three fingers of the left hand when is held properly and firmly. Additionally, device 46, by the force of the portion of compressible element 50 extending through the two holes 52 on the other side of main member 48, exerts forces on the middle and fourth fingers of the right hand. The three holes 52 are "l" apart, as are the other two holes 52. In this embodiment, "l" is approximately 10 mm. Preferably, the outer surfaces of compressible element 50 include layers 54 (sized and configured similarly to cap 26 of FIGS. 1 and 2 or a variation thereof) with a texture similar to the texture of the outer surface device 48, the texture of a golf club grip. As the user firmly grips the device, compressible element 50 asserts an opposing force against the specified fingers.

Figure 9:
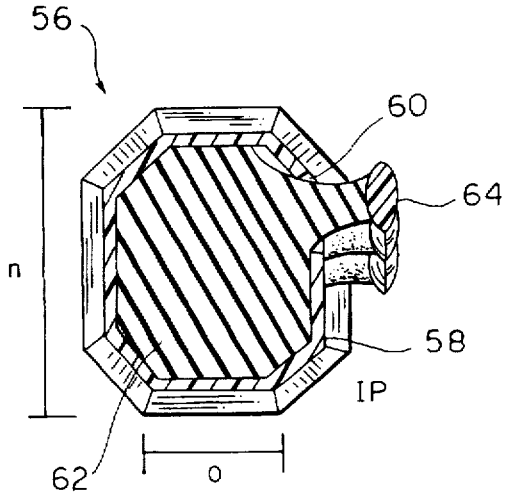
FIG. 9 is a view, in cross section, of the device shown in FIG. 8.
Figure 8:
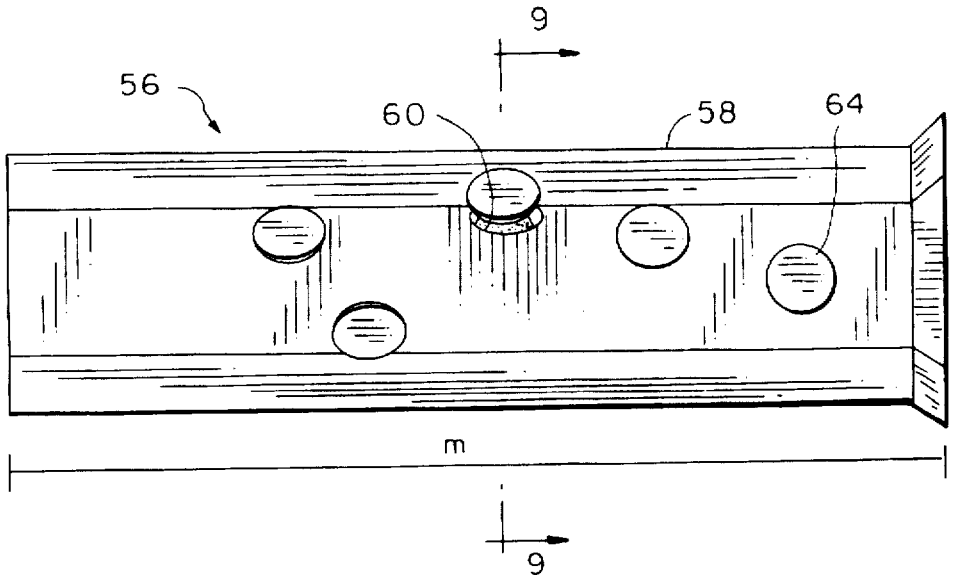
FIG. 8 is a side view of an embodiment of the invention that resembles a tennis grip.

FIGS. 8 and 9 show an embodiment of the present invention where main member 58 of device 56 is configured similar to the grip of a tennis racket. Main member 52 is a tube measuring "m" in length, roughly configured, in cross section, as an elongated octagon with dimensions of "n" and "o" and a thickness of "p". In this embodiment, "m", "n", "o" and "p" are approximately 125 mm, 35 mm, 31 mm and 3 mm, respectively. Also, in this embodiment, holes 60 for each of the fingers of each hand are separated, along a center line running from one end of device 56 to the other, by a distance of approximately 10 mm. Protruding through holes 60 are portions of compressible element 62, which is enclosed in main member 58. The outer surfaces of each portion of compressible element 62 are covered by caps 64.

Figure 10:
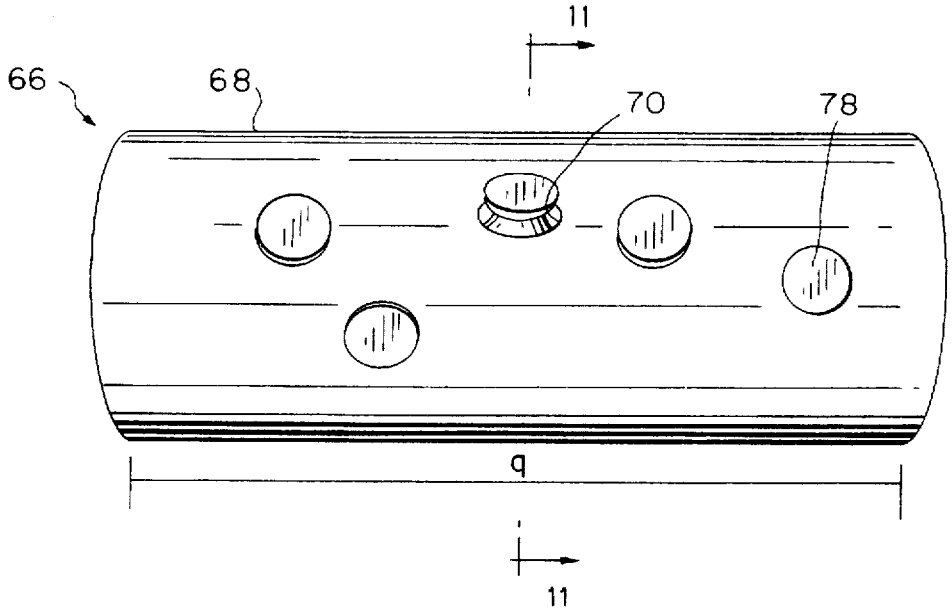
FIG. 10 is a side view of an embodiment of the invention that resembles the grip of an axe.
Figure 11:
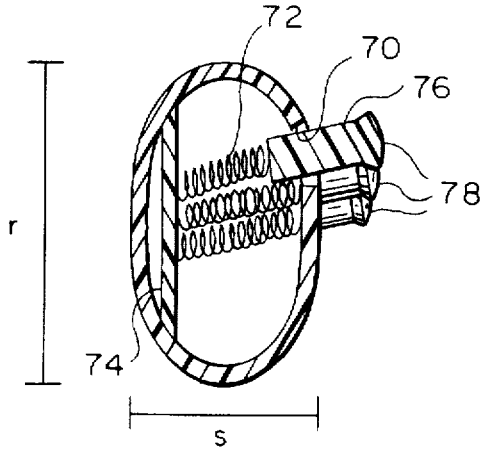
FIG. 11 is a view, in cross section, of the device shown in FIG. 10.

FIGS. 10 and 11 show device 66, which is configured similar to the handle of an axe. In this embodiment of the present invention, main member 68 is "q" long, with an oblong-shaped end having radii with dimensions measuring "r" and "s". Preferably, "q", "r" and "s"are approximately 100 mm, 42 mm and 23 mm, respectively. Holes 70 in main member 68 are separated, along a center line running from one end of device 66 to the other, by a distance of approximately 10 mm. Compressible elements 72 are springs, which are attached to the inner surface of main member 66 by support 74. Attached to the other end of compressible elements 72 are pegs 76, which protrude through holes 70. Outer surfaces 78 of pegs 76 preferably have the same texture as the surface of main member 66.

Figure 12:
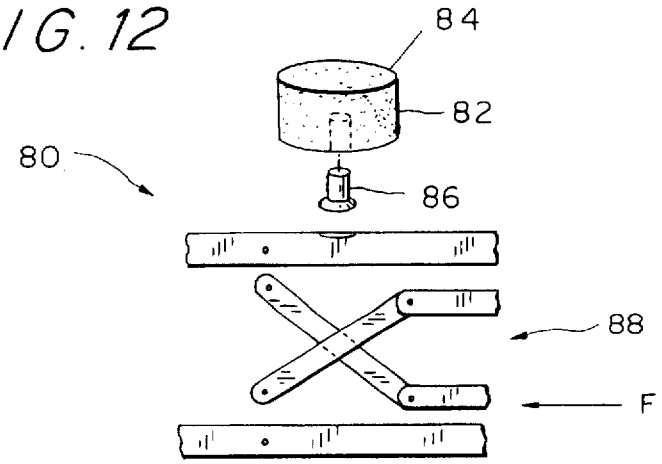
FIG. 12 is an exploded, partial view of an embodiment of a compressible element.

FIG. 12 shows a portion of another embodiment of a compressible element. Compressible element 80 includes peg 82 with outer layer 84, stem 86 and supporting structure 88. In this embodiment, supporting structure 88, with stem 86, is sized and configured to fit inside of a desirable grip or handle. Peg 82, made of rubber or some other elastic material, exerts a force on the user's finger when device in which compressible element 80 is housed is held firmly. Supporting structure 88 may be expanded by the application of a force (represented in FIG. 12 by "F") to cause peg 82 to move away from the farthest element of supporting structure 88. One of ordinary skill in the art would realize that supporting structure 88 may be immovable, if necessary, in other embodiments of the present invention. In some embodiments, stems 86 may be used to force covers over the holes in which compressible element 80 is housed out of their respective holes by moving stems 86 through such holes. Peg 84 preferably has an orifice in its bottom (not shown in FIG. 12) to accommodate a frictional fit between stem 86 and peg 84. Peg 84 can be situated on stem 86 to correspond to the finger the user wishes to exercise.

Figure 13:
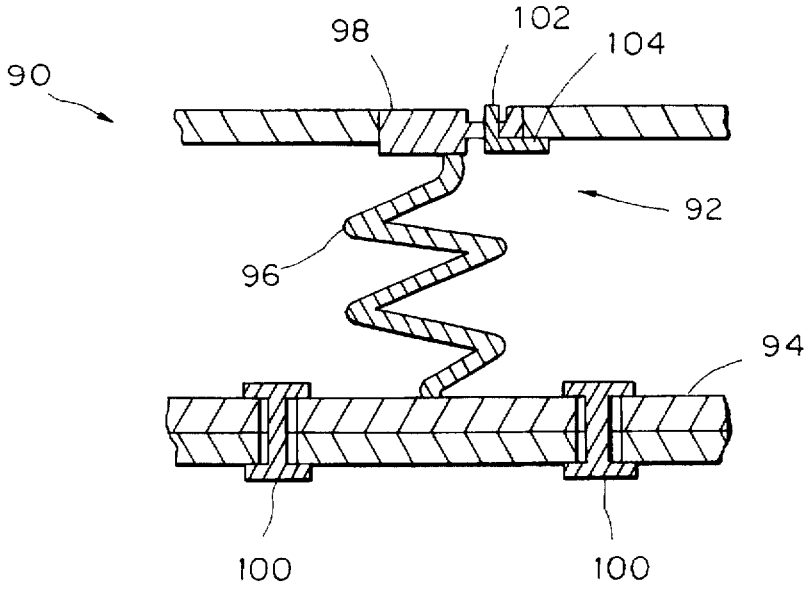
FIG. 13 is a partial view, in cross section, of another embodiment of a compressible element.

FIG. 13 shows partial view of another embodiment of the present invention. Device 90 includes compressible element 92. Compressible element 92 includes support 94, spring 96 and cap 98. Spring 96 may be removable attached to support 94, preferably metallic, by, for example, a weld or other fastening means. Support 94 may be affixed to the inside surface of device 90 by, for example, any known means, such as rivets 100 or other means known to one of ordinary skill in the art. The user of device 90 may lock cap 98 in the compressed position by manipulating tab 102, which is connected to locking member 104. The combination to tab 102 and locking member 104, to lock and unlock the outer surface of cap 98, is movable by asserting a force on tab 102 and moving it across the surface of cap 98. By moving tab 102 from a point in proximity with the center of cap 98 toward the outer edge of cap 98 when spring 96 is compressed, with cap 98 in alignment with the outer surface of device 90, locking member 104 can be used to lock cap 96 in the compressed configuration. Locking cap 96 in alignment with the main surface of device 90 negates the forces exertable by compressible element 92 upon the particular finger(s) of the user. This locking capability allows device 90 to exercise and strengthen fingers corresponding to the unlocked compressible elements. One of ordinary skill in the art would realize that other types of locking systems could be used to attain the same restraint upon the compressible element and that such locking systems could be used in connection with other embodiments of the present invention.

The dimensions "a" through "s" could be of any size desired by the user(s) of the respective device(s).

The present invention also includes a method of exercising and strengthening specific fingers of a hand. Using an exercising and strengthening device that is desirably configured and sized, the method includes the step of locking selected compressible element(s) corresponding to finger(s) not to be exercised or strengthened in a compressed state, grasping the device, exerting a force upon the unlocked compressible element(s), and holding the device firmly with all fingers aligned in proximity with the surface of the device. A device with a desirable configuration and size could be a simple cylinder sized to fit in the user's hand or could resemble the grip of an instrumentality used for sports or hand work (e.g., tools). The method may also include the step of moving the finger(s) upon which the force is being exerted away from the device and then moving the finger(s) again toward the device into alignment with its surface. The locking step may include the sub-steps of sliding a locking member into contact with the compressible element(s) to be locked in place.

The above embodiments are merely illustrations of the apparatus claimed herein. The invention also includes other embodiments not specifically disclosed above, embodiments which one of ordinary skill in the art would realize and envision as equivalents or derivations of the embodiments shown as existing in other specific forms without departing from its spirit or essential attribution. Numerous variations may be made within the scope of this invention and without sacrificing its chief advantages. Thus, the terms and expressions have been used as terms of description and not terms of limitation. Instead, reference should be made to the appended claims, rather than to the foregoing specification and drawings, as indicating the scope of the apparatus invention.

What is claimed is:

1. A hand-held device comprising:

a main member configured to be engulfed when held firmly in at least one hand of user;

a compressible element extending outwardly from the main member, said compressible element having an outer surface positioned to exert a force away from the surface of the main member upon at least one finger of the user of the device as the user engulfs the device; and, a locking mechanism capable of holding the compressible element in a compressed position.

2. A hand-held device comprising:

a main member configured to be engulfed when held firmly in at least one hand of user;

a compressible element extending outwardly from the main member, said compressible element having an outer surface positioned to exert a force away from the surface of the main member upon at least one finger of the user of the device as the user engulfs the device, wherein the compressible element comprises at least one spring; and a peg protruding outward and away from the surface of the main member and connected to the spring in the main member; wherein the peg includes a locking member.

3. A method for exercising and strengthening specific fingers of a hand, comprising the steps of:

locking selected compressible element(s) of an exercising and strengthening device, desirably configured and sized, that correspond to finger(s) not to be exercised or strengthened in a compressed state;

grasping the device;

exerting a force upon the unlocked compressible element (s); and holding the device firmly with all the fingers aligned in proximity with the surface of the device.

4. The method recited in claim 3 wherein the device is a cylinder sized to fit in the user's hand.

5. The method recited in claim 3 wherein the device is configured and sized to resemble an instrumentality used as part of a sports apparatus.

6. The method recited in claim 3 further comprising the steps of:

moving the finger(s) upon which the force in being exerted away from the device and moving the finger(s) again toward the device into alignment with the surface of the device.

7. The method recited in claim 3 wherein the locking step comprises the step of sliding a locking member into contact with the compressible element(s) to be locked in place.

* * * * *